US008800515B1

(12) United States Patent
Smith

(10) Patent No.: US 8,800,515 B1
(45) Date of Patent: Aug. 12, 2014

(54) CAM TORQUE ACTUATED VARIABLE CAMSHAFT TIMING DEVICE WITH A BI-DIRECTIONAL OIL PRESSURE BIAS CIRCUIT

(71) Applicant: BorgWarner Inc., Auburn Hills, MI (US)

(72) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 13/799,731

(22) Filed: Mar. 13, 2013

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | |
|---|---|---|---|
| 4,627,825 | A | 12/1986 | Bruss et al. |
| 4,858,572 | A | 8/1989 | Shirai et al. |
| 5,002,023 | A | 3/1991 | Butterfield et al. |
| 5,107,804 | A | 4/1992 | Becker et al. |
| 5,497,738 | A | 3/1996 | Siemon et al. |
| 5,657,725 | A | 8/1997 | Butterfield et al. |
| 5,738,056 | A | 4/1998 | Mikame et al. |
| 5,797,361 | A | 8/1998 | Mikame et al. |
| 5,924,395 | A | 7/1999 | Moriyo et al. |
| 6,170,448 | B1 | 1/2001 | Asakura |
| 6,276,321 | B1 | 8/2001 | Lichti et al. |
| 6,311,655 | B1 | 11/2001 | Simpson et al. |
| 6,453,859 | B1 | 9/2002 | Smith et al. |
| 6,481,402 | B1 | 11/2002 | Simpson et al. |
| 6,526,930 | B2 | 3/2003 | Takahashi et al. |
| 6,591,799 | B1 | 7/2003 | Hase et al. |
| 6,666,181 | B2 | 12/2003 | Smith et al. |
| 6,684,835 | B2 | 2/2004 | Komazawa et al. |
| 6,745,735 | B2 | 6/2004 | Smith |
| 6,763,791 | B2 | 7/2004 | Gardner et al. |
| 6,814,038 | B2 | 11/2004 | Smith |
| 6,941,913 | B2 | 9/2005 | Smith |
| 6,997,150 | B2 | 2/2006 | Simpson |
| 7,240,651 | B1 | 7/2007 | Hanshaw |
| 7,255,077 | B2 | 8/2007 | Simpson et al. |
| 7,765,966 | B2 | 8/2010 | Leone |
| 8,220,427 | B2 * | 7/2012 | Child ..... 123/90.15 |
| 8,356,583 | B2 | 1/2013 | Smith |
| 8,387,574 | B2 | 3/2013 | McCloy et al. |

FOREIGN PATENT DOCUMENTS

| | | |
|---|---|---|
| CN | 101046165 A | 10/2007 |
| GB | 2278661 A | 12/1994 |
| GB | 2437305 | 10/2007 |
| JP | 11-210424 | 8/1999 |

OTHER PUBLICATIONS

Miura, T. et al.; "Development of a Hydraulic Variable Valve Timing Control System with an Optimum Angular Position Locking Mechansim"; SAE International; 2012; 14 pages.

* cited by examiner

*Primary Examiner* — Ching Chang
(74) *Attorney, Agent, or Firm* — Brown & Michaels, PC

(57) ABSTRACT

A phaser with a cam torque actuated vane defining cam torque actuated advance and retard chambers and an oil pressure actuated vane defining oil pressure actuated advance and retard chambers. The phaser is moved to an advance position and a retard position through both cam torque energy and oil pressure energy. The holding position of the phaser is maintained through oil pressure energy.

12 Claims, 6 Drawing Sheets

CAM TORQUE ACTUATED VARIABLE CAMSHAFT TIMING DEVICE WITH A BI-DIRECTIONAL OIL PRESSURE BIAS CIRCUIT

BACKGROUND OF THE INVENTION

1. Field of the Invention

The invention pertains to the field of variable cam timing phasers. More particularly, the invention pertains to cam torque actuated variable cam timing devices with a bi-directional oil pressure bias circuit.

2. Description of Related Art

It has been demonstrated that operating a variable camshaft timing device phaser utilizing the camshaft torque energy to phase the valve timing device is desirable because of the low amount of oil required by a camshaft torque actuated variable camshaft timing device. However, not all engines provide enough camshaft torque energy throughout the entire engine operating range to effectively phase the variable camshaft timing device.

SUMMARY OF THE INVENTION

The present invention supplements the camshaft torque energy with engine oil pressure to allow the variable camshaft timing device to phase when camshaft torque is low.

DETAILED DESCRIPTION OF THE INVENTION

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor assembly 105 with one or more vanes 104*a*, 104*b*, mounted to the end of the camshaft, surrounded by a housing assembly 100 with the vane chambers into which the vanes fit. It is possible to have the vanes 104*a*, 104*b* mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

FIGS. 1-6 show the operating modes of the VCT phaser depending on the spool valve position. The positions shown in the figures define the direction the VCT phaser is moving. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Figure 1:
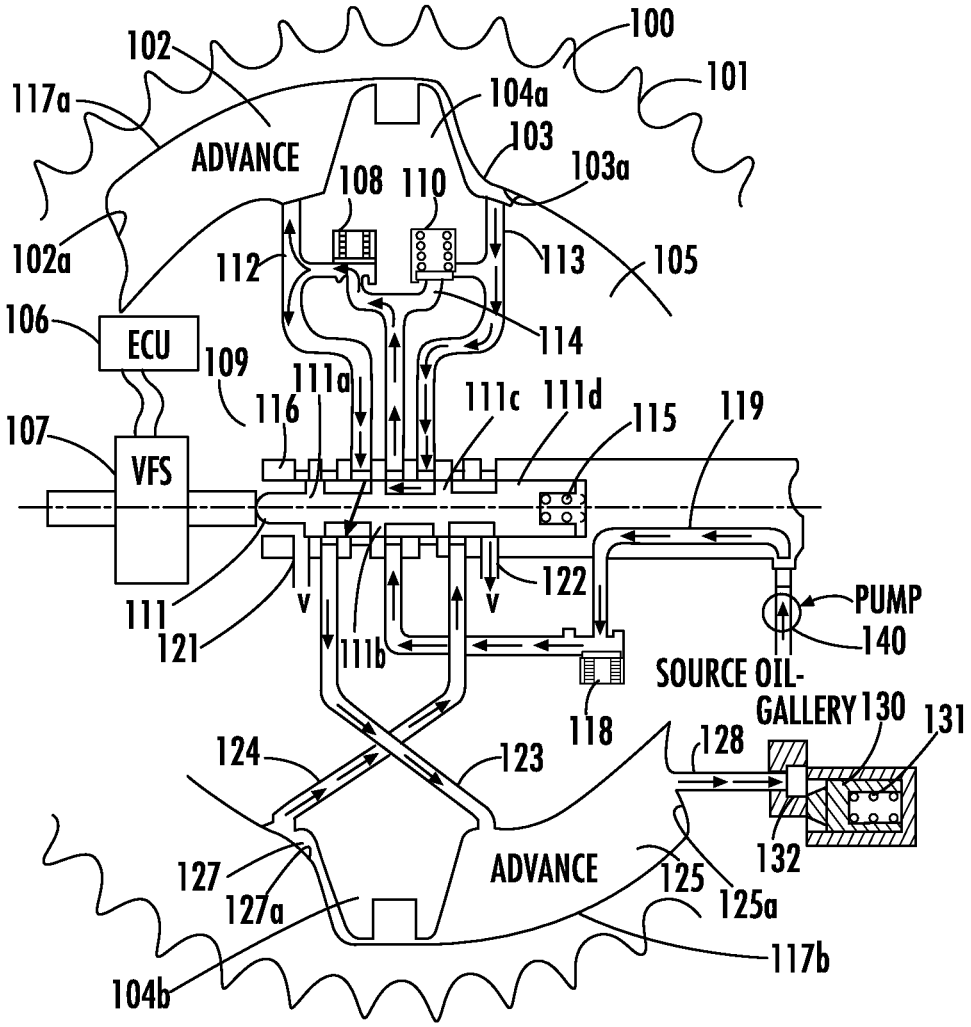
FIG. 1 shows a schematic of a phaser of a first embodiment moving towards the advance position.
Figure 2:
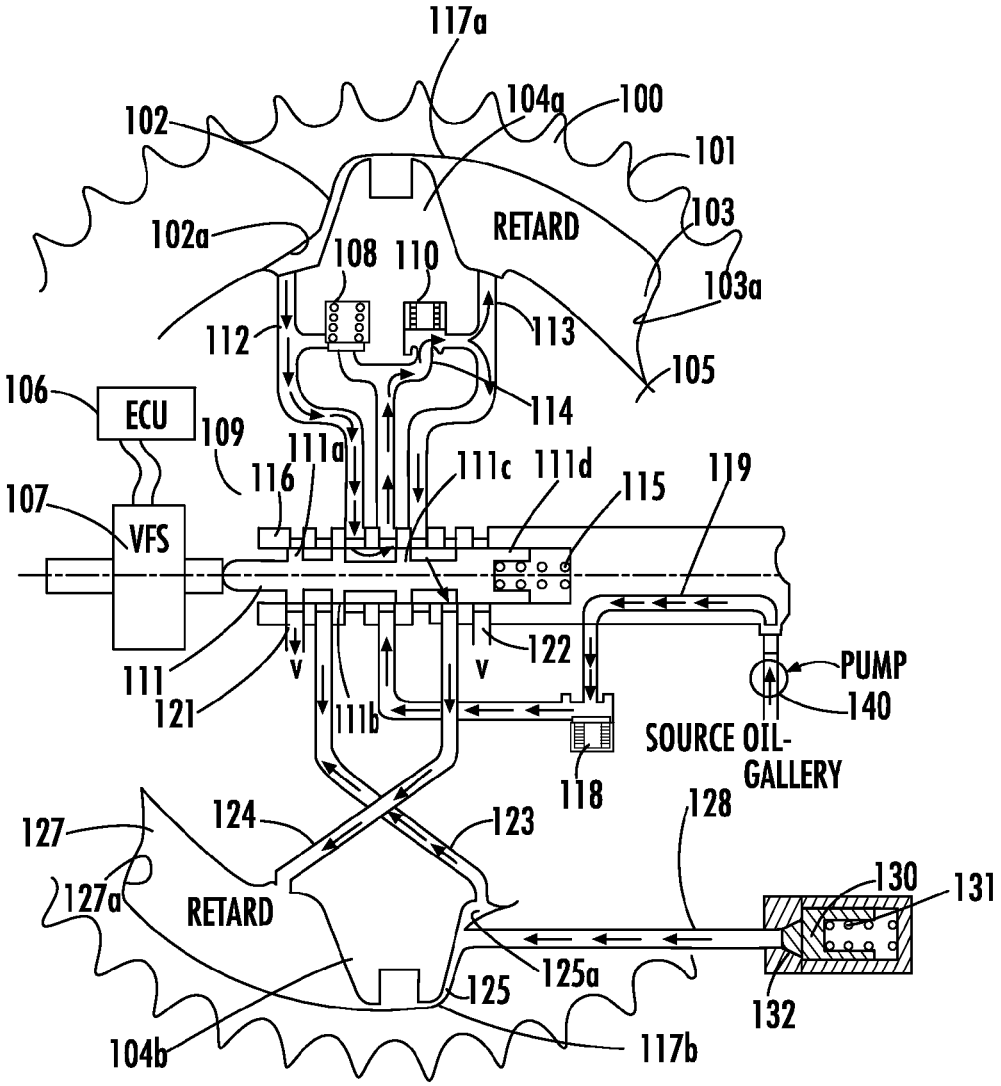
FIG. 2 shows a schematic of a phaser of a first embodiment moving towards the retard position.
Figure 3:
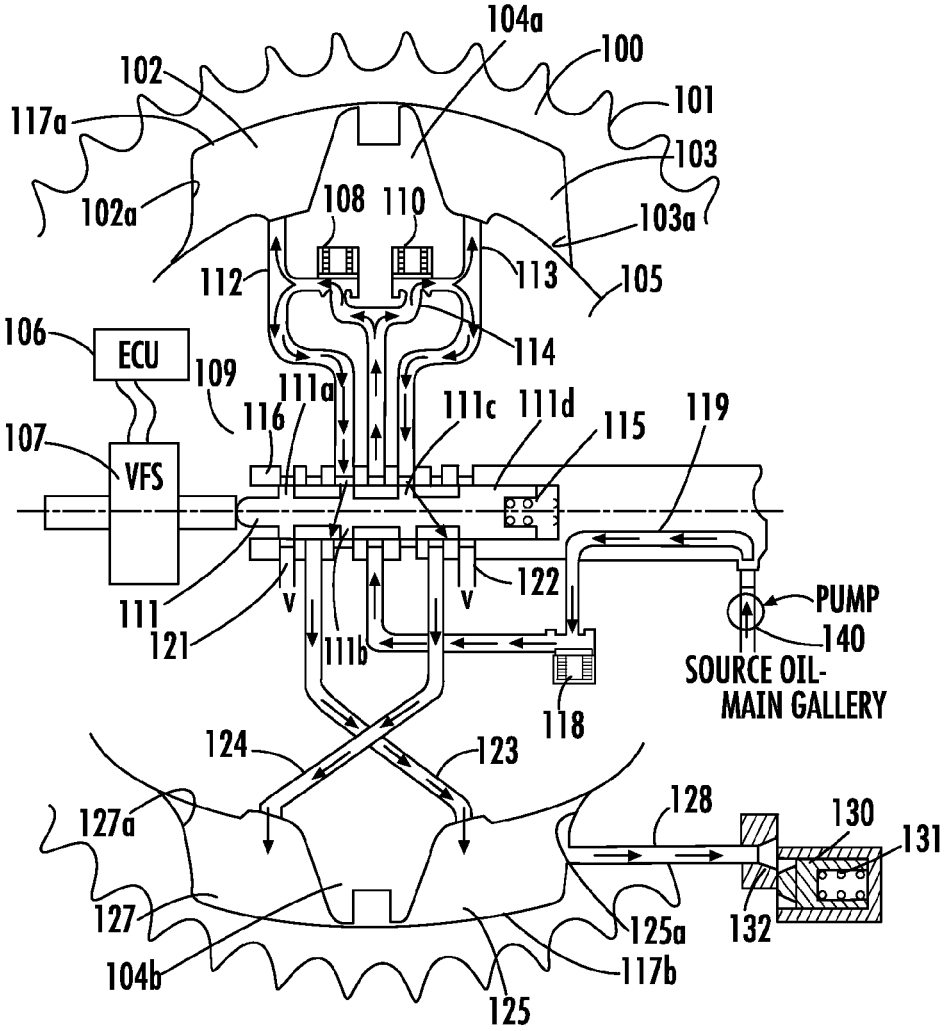
FIG. 3 shows a schematic of a phaser of a first embodiment in the null or holding position.

In the first embodiment, the porting to the oil pressure actuated chambers 125, 127 through the control valve 109 are separately axially along the sleeve 116. Referring to FIGS. 1-3 of the first embodiment, the housing assembly 100 of the phaser has an outer circumference 101 for accepting drive force. The rotor assembly 105 is connected to the camshaft and is coaxially located within the housing assembly 100. The rotor assembly 105 has at least two vanes, a cam torque actuated vane 104*a* and an oil pressure actuated vane 104*b*. The cam torque actuated (CTA) vane 104*a* separates chamber 117*a*, formed between the housing assembly 100 and the rotor assembly 105 into a cam torque actuated (CTA) advance chamber and a cam torque actuated (CTA) retard chamber 103.

Torque reversals in the camshaft caused by the forces of opening and closing engine valves move the CTA vane 104*a*. The CTA advance and retard chambers 102, 103 are arranged to resist positive and negative torque pulses in the camshaft and are alternatively pressurized by the cam torque. The control valve 109 allows the CTA vane 104*a* in the phaser to move by permitting fluid flow from the CTA advance chamber 102 to the CTA retard chamber 103 or vice versa, depending on the desired direction of movement.

The oil pressure actuated (OPA) vane 104*b* separates chamber 117*b*, formed between the housing assembly 100 and the rotor assembly 105 into an oil pressure actuated (OPA) advance chamber 125 and an oil pressure actuated (OPA) retard chamber 127. The OPA vane 104*b* is assisted by engine oil pressure actuation.

The vanes 104*a*, 104*b* are capable of rotation to shift the relative angular position of the housing assembly 100 and the rotor assembly 105.

A lock pin 130 is slidably housed in a bore in the rotor assembly 105 and has an end portion that is biased towards and fits into a recess 132 in the housing assembly 100 by a spring 131. In a locked position, the end portion of the lock pin 130 engages the recess 132 of the housing assembly 100. In an unlocked position, the end portion of the lock pin 130 does not engage the housing assembly 100. Alternatively, the lock pin 130 may be housed in the housing assembly 100 and be spring 131 biased towards a recess 132 in the rotor assembly 105.

In FIGS. 1-6, the pressurization of the lock pin 130 is controlled by the fluid in the OPA advance chamber 125 through line 128 in fluid communication with the recess 132. With the lock pin 130 controlled by fluid in the OPA advance chamber 125, the phaser can be locked in the retard position by venting the OPA advance chamber 125, such that the lock pin 130 will engage at a retard stop. Alternatively, the pressurization of the lock pin 130 may be controlled by fluid in the OPA retard chamber 127. With the lock pin 130 controlled by fluid in the OPA retard chamber 127, the phaser can be locked in the advance position by venting the OPA retard chamber 127, such that the lock pin 130 will engage at an advance stop.

The CTA advance chamber 102 is connected to the CTA retard chamber 103 through advance line 112, retard line 113, common line 114, the advance check valve 108, the retard check valve 110 and the control valve 109. The OPA advance chamber 125 is connected to the control valve 109 through advance oil pressure line 123 and the OPA retard chamber 127 is connected to the control valve 109 through retard oil pressure line 124.

A control valve 109, preferably a spool valve, includes a spool 111 with cylindrical lands 111*a*, 111*b*, 111*c*, and 111*d* slidably received in a sleeve 116. The control valve may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the lock pin 130 is in a locked or unlocked position. The control valve 109 has an advance mode, a retard mode, and a holding position.

FIG. 1 shows the phaser moving towards the advance position. To move towards the advance position, the duty cycle is increased to greater than 50%, the force of the VFS 107 on the spool 111 is increased and the spool 111 is moved to the right by the VFS 107 in an advance mode, until the force of the spring 115 balances the force of the VFS 107.

In the advance mode shown, spool land 111*a* blocks the exit of fluid through exhaust line 121 from the CTA advance chamber 102. Lines 113 and 114 are open to the CTA advance chamber 102 and the CTA retard chamber 103. Camshaft torque pressurizes the CTA retard chamber 103, causing fluid to move from the CTA retard chamber 103 and into the CTA advance chamber 102, and the CTA vane 104*a* to move towards the retard wall 103*a*. Fluid exits from the CTA retard chamber 103 through line 113 to the control valve 109 between spool lands 111*a* and 111*b* and recirculates back to common line 114 and line 112 leading to the CTA advance chamber 102.

Fluid flowing to the CTA advance chamber 102 also flows through advance line 112 and between spool lands 111*a* and 111*b* to the OPA chamber 125 through line 123, moving OPA vane 104*b* towards the retard wall 127*a*, in effect aiding the movement of CTA vane 104*a* towards the retard wall 103*a*. Fluid in the OPA advance chamber 125 pressurizes lock pin line 128, biasing the lock pin 130 against the spring 131, away from the recess 132 and to an unlocked position. Fluid from the OPA retard chamber 127 exits to exhaust line 122, through the control valve 109 between spool lands 111*c* and 111*d* and through line 124.

Makeup oil is supplied to the phaser from supply S by pump 140 to make up for leakage and enters line 119. Line 119 leads to an inlet check valve 118 and the control valve 109. From the control valve 109, fluid enters line 114 through the advance check valve 108 and flows to the CTA advance chamber 102 and to the OPA advance chamber 125.

By allowing fluid to flow from the CTA retard chamber 103 to common line 114 through the advance check valve 108 and filling the CTA advance chamber 102; having spool land 111*a* block the CTA advance chamber 102 from exhausting to exhaust line 121; and allowing the OPA retard chamber 127 to exhaust to sump through exhaust line 122, causes the phaser to move the CTA vane 104*a* using cam torque energy and assistance from engine oil pressure to move the OPA vane 104*b*, therefore the phaser can be actuated from either or both sources of energy, cam torque energy or source oil pressure energy.

When the duty cycle is set between 20-50%, the vane of the phaser is moving toward and/or in a retard position.

FIG. 2 shows the phaser moving towards the retard position. To move towards the retard position, the duty cycle is changed to greater than 0% but less than 50%, the force of the VFS 107 on the spool 111 is reduced and the spool 111 is moved to the left in a retard mode in the figure by spring 115, until the force of spring 115 balances the force of the VFS 107.

In the retard mode shown, spool land 111*d* blocks the exit of fluid through exhaust line 122 from the CTA retard chamber 103. Lines 112 and 114 are open to the CTA advance chamber 102 and the CTA retard chamber 103. Camshaft torque pressurizes the CTA advance chamber 102, causing fluid in the CTA advance chamber 102 to move into the CTA retard chamber 103, and the vane 104*a* to move towards the advance chamber wall 102*a*. Fluid exits from the CTA advance chamber 102 through line 112 to the control valve 109 between spool lands 111*b* and 111*c* and recirculates back to common line 114 and line 113 leading to the CTA retard chamber 103.

Fluid flowing to the CTA retard chamber 103 also flows through the retard line 113 and between spool lands 111*c* and 111*d* to the OPA retard chamber 127, moving the OPA vane 104*b* towards the advance wall 125*a*, in effect aiding the movement of CTA vane 104*a* towards the advance wall 102*a*. Fluid from the OPA advance chamber 125 exits to exhaust line 121, through the control valve 109 between spool lands 111*a* and 111*b* and through line 123. Since fluid is exiting the OPA advance chamber 125, the lock pin line 128 is depressurized and spring 131 biases the end portion of the lock pin 130 into engagement with the recess 132 of the housing assembly 100.

Makeup oil is supplied to the phaser from supply S by pump 140 to make up for leakage and enters line 119. Line 119 leads to an inlet check valve 118 and the control valve 109. From the control valve 109, fluid enters line 114 through the retard check valve 110 and flows to the CTA retard chamber 103.

By allowing fluid to flow from the CTA advance chamber 102 to common line 114 through the retard check valve 110 and filling the CTA retard chamber 103; having spool land 111*d* block the CTA retard chamber 102 from exhausting to exhaust line 122; and allowing the OPA advance chamber 125 to exhaust to sump through exhaust line 121, cause the phaser to move the CTA vane 104*a* to using cam torque energy and assistance from engine oil pressure to move the OPA vane 104*b*, therefore the phaser can be actuated from either or both sources of energy, cam torque energy or source oil pressure energy.

The holding position of the phaser preferably takes place between the retard and advance position of the vane relative to the housing.

FIG. 3 shows the phaser in the null or holding position. In this position, the duty cycle of the variable force solenoid 107 is approximately 50% and the force of the VFS 107 on one end of the spool 111 equals the force of the spring 115 on the opposite end of the spool 111 in holding mode. The lands 111*b* and 111*c* restrict the flow of fluid from the advance line 112 connected to the CTA advance chamber 102 and to the OPA advance chamber 125 and the flow of fluid from the retard line 113 connected to the CTA retard chamber 103 and to the OPA retard chamber 127. Spool land 111*a* blocks exhaust line 121 and spool land 111*d* blocks exhaust line 122.

Makeup oil is supplied to the phaser from supply S by pump 140 to make up for leakage and enters line 119. Line 119 leads to an inlet check valve 118 and the control valve

109. From the control valve 109, fluid enters line 114 through the advance check valve 108 to the CTA advance chamber 102 and through the retard check valve 110 to the CTA retard chamber 103.

The spool valve 111 is positioned such that fluid can flow from supply, through the advance check valve 108 and the retard check valve 110 to the CTA advance chamber 102 and the CTA retard chamber 103 and then to the OPA advance chamber 125 and the OPA retard chamber 127. Fluid in the OPA advance chamber 125 pressurizes lock pin line 128, biasing the lock pin 130 against the spring 131, away from the recess 132 and to an unlocked position. Since equal pressure is being applied to both the OPA advance chamber 125 and the OPA retard chamber 127 the phaser will maintain position.

Figure 4:
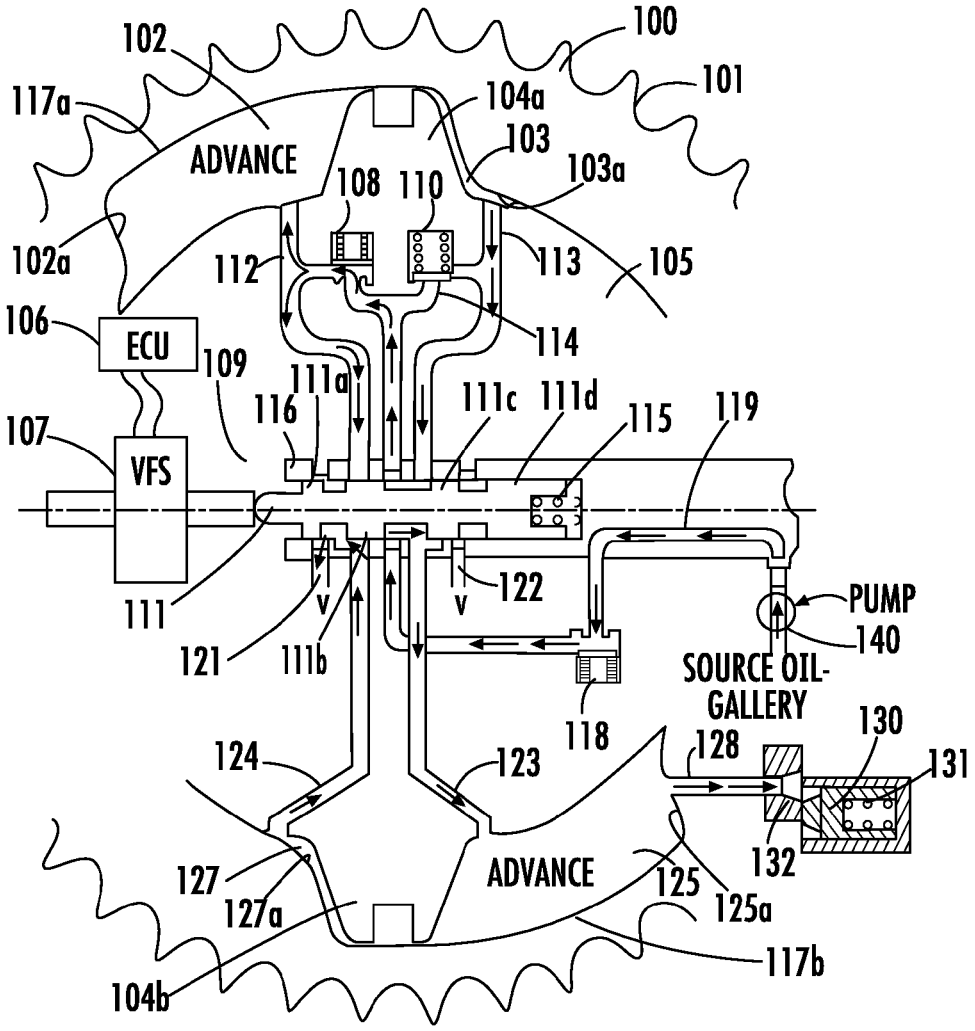
FIG. 4 shows a schematic of a phaser of a second embodiment moving towards the advance position.
Figure 5:
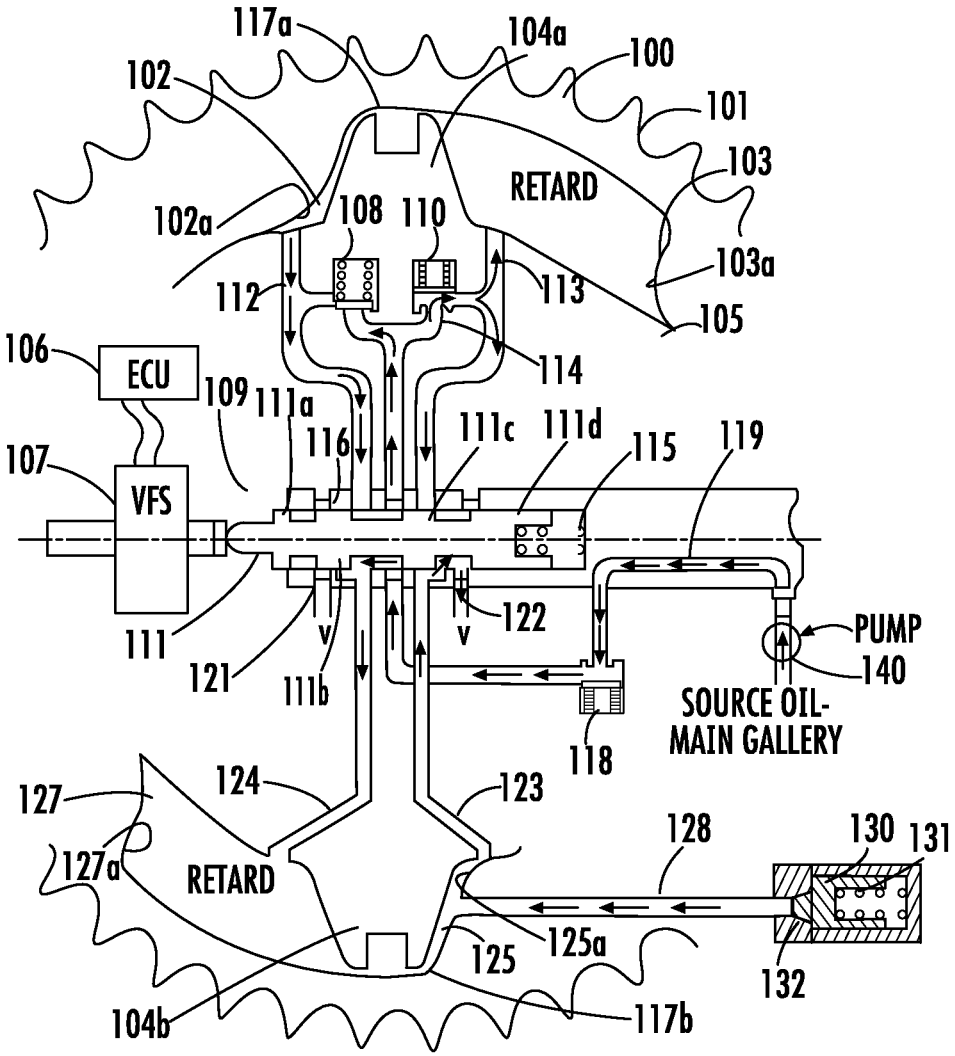
FIG. 5 shows a schematic of a phaser of a second embodiment moving towards the retard position.
Figure 6:
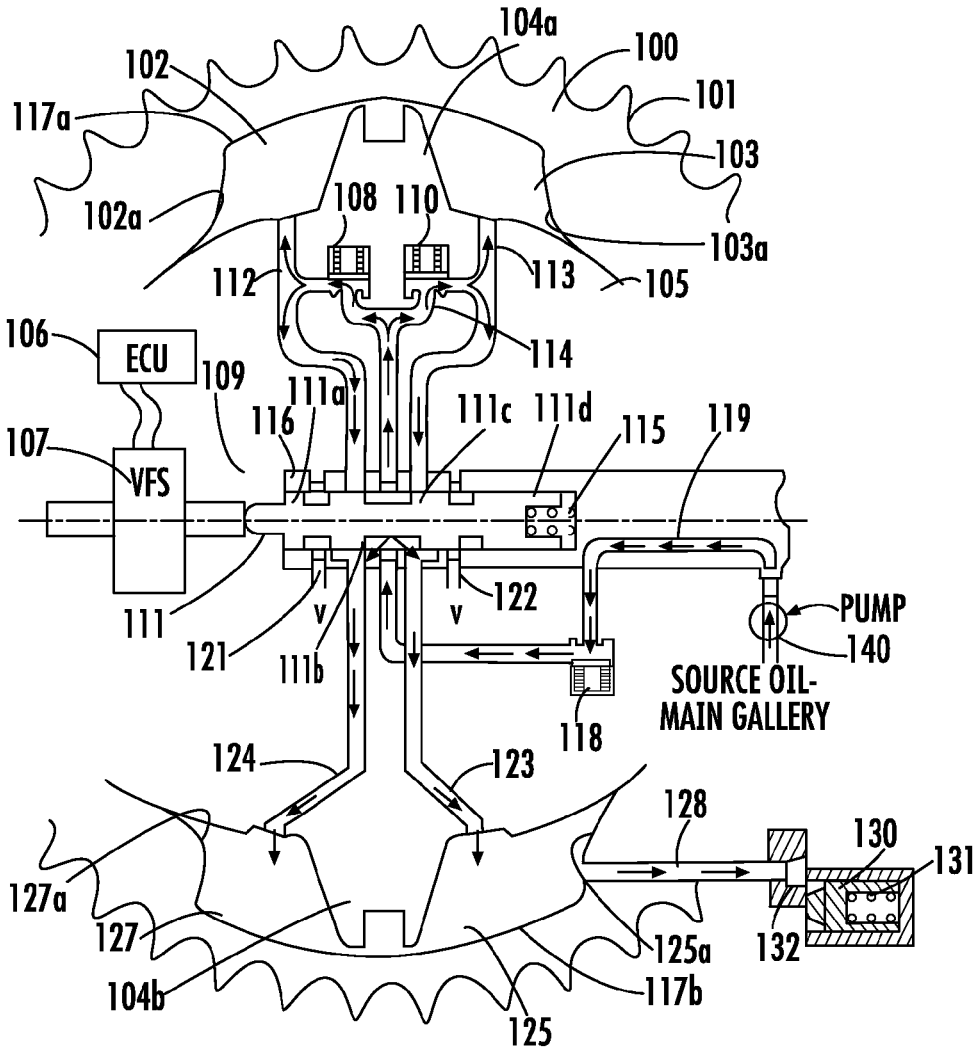
FIG. 6 shows a schematic of a phaser of a second embodiment in the null or holding position.

In the second embodiment shown in FIGS. 4-6, the porting to the OPA chambers 125, 127 and the CTA chambers 102, 103 is coplanar and separated from each other radially around the sleeve 116. An advantage of having the porting for the OPA chambers 125, 127 and the CTA chambers 102, 103 coplanar and separated from each other radially around the sleeve 116, is that the oil is directed to the OPA chambers 125, 127 does not have to flow through the advance or retard check valves 108, 110 as in the first embodiment.

Referring to FIGS. 4-6 of the second embodiment, the housing assembly 100 of the phaser has an outer circumference 101 for accepting drive force. The rotor assembly 105 is connected to the camshaft and is coaxially located within the housing assembly 100. The rotor assembly 105 has at least two vanes, a CTA vane 104*a* and an OPA vane 104*b*. The CTA vane 104*a* separates chamber 117*a*, formed between the housing assembly 100 and the rotor assembly 105 into a CTA advance chamber and a CTA retard chamber 103. Torque reversals in the camshaft caused by the forces of opening and closing engine valves move the CTA vane 104*a*. The CTA advance and retard chambers 102, 103 are arranged to resist positive and negative torque pulses in the camshaft and are alternatively pressurized by the cam torque. The control valve 109 allows the CTA vane 104*a* in the phaser to move by permitting fluid flow from the CTA advance chamber 102 to the CTA retard chamber 103 or vice versa, depending on the desired direction of movement.

The OPA vane 104*b* separates chamber 117*b*, formed between the housing assembly 100 and the rotor assembly 105 into an OPA advance chamber 125 and an OPA retard chamber 127. The OPA vane 104*b* is assisted by engine oil pressure actuation.

The vanes 104*a*, 104*b* are capable of rotation to shift the relative angular position of the housing assembly 100 and the rotor assembly 105.

A lock pin 130 is slidably housed in a bore in the rotor assembly 105 and has an end portion that is biased towards and fits into a recess 132 in the housing assembly 100 by a spring 131. In a locked position, the end portion of the lock pin 130 engages the recess 132 of the housing assembly 100. In an unlocked position, the end portion of the lock pin 130 does not engage the housing assembly 100. Alternatively, the lock pin 130 may be housed in the housing assembly 100 and be spring 131 biased towards a recess 132 in the rotor assembly 105.

In FIGS. 4-6, the pressurization of the lock pin 130 is controlled by the fluid in the OPA advance chamber 125 through line 128 in fluid communication with the OPA advance chamber 125. With the lock pin 130 controlled by fluid in the OPA advance chamber 125, the phaser can be locked in the retard position by venting the OPA advance chamber 125, such that the lock pin 130 will engage at a retard stop. Alternatively, the pressurization of the lock pin 130 may be controlled by fluid in the OPA retard chamber 127. With the lock pin 130 controlled by fluid in the OPA retard chamber 127, the phaser can be locked in the advance position by venting the OPA retard chamber 127, such that the lock pin 130 will engage at an advance stop.

The CTA advance chamber 102 is connected to the CTA retard chamber 103 through advance line 112, retard line 113, common line 114, the advance check valve 108, the retard check valve 110 and the control valve 109. The OPA advance chamber 125 is connected to the control valve 109 through oil pressure advance line 224 and the OPA retard chamber 127 is connected to the control valve 109 through oil pressure retard line 223.

A control valve 109, preferably a spool valve, includes a spool 111 with cylindrical lands 111*a*, 111*b*, 111*c*, and 111*d* slidably received in a sleeve 116. The control valve may be located remotely from the phaser, within a bore in the rotor assembly 105 which pilots in the camshaft, or in a center bolt of the phaser. The lengths of the lands 111*a*, 111*b*, 111*c*, and 111*d* of the spool 111 are such that the CTA chambers 102, 103 are not open to exhaust lines 122, 121 to vent during the movement of the spool 111. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the lock pin 130 is in a locked or unlocked position. The control valve 109 has an advance mode, a retard mode, and a holding position.

FIG. 4 shows the phaser moving towards the advance position. To move towards the advance position, the duty cycle is increased to greater than 50%, the force of the VFS 107 on the spool 111 is increased and the spool 111 is moved to the right by the VFS 107 in an advance mode, until the force of the spring 115 balances the force of the VFS 107.

In the advance mode shown, spool land 111*b* blocks the exit of fluid through exhaust line 121 from the CTA advance chamber 102. Lines 113 and 114 are open to the CTA retard chamber 103. Camshaft torque pressurizes the CTA retard chamber 103, causing fluid to move from the CTA retard chamber 103 and into the CTA advance chamber 102, and the CTA vane 104*a* to move towards the retard wall 103*a* through cam torque energy. Fluid exits from the CTA retard chamber 103 through line 113 to the control valve 109 between spool lands 111*b* and 111*c* and recirculates back to common line 114, the advance check valve 108 and line 112 leading to the CTA advance chamber 102.

Fluid flowing to the CTA advance chamber 102 is prevented from flowing out of line 112 and through the control valve 109 by spool land 111*b*. Fluid exiting out of the CTA retard chamber 103, in addition to fluid from the supply line 119 flows into the OPA advance chamber 125, moving the OPA vane 104*b* towards the retard wall 127*a*, therefore aiding the movement of the CTA vane 104*a* with oil pressure energy. Fluid in the OPA retard chamber 127 exits the chamber through line 223, and through the control valve between spool lands 111*a* and 111*b* to exhaust line 121. Therefore, the phaser can be actuated from either or both sources of energy, cam torque energy or source oil pressure energy.

Fluid in the OPA advance chamber 125 pressurizes lock pin line 128, biasing the lock pin 130 against the spring 131, away from the recess 132 and to an unlocked position.

Makeup oil is supplied to the phaser from supply S by pump 140 to make up for leakage and enters line 119. Line 119 leads to an inlet check valve 118 and the control valve 109. From the control valve 109, fluid enters line 114 through the advance check valve 108 and flows to the CTA advance chamber 102.

When the duty cycle is set between 0-50%, the vane of the phaser is moving toward and/or in a retard position.

FIG. 5 shows the phaser moving towards the retard position. To move towards the retard position, the duty cycle is changed to greater than 0% but less than 50%, the force of the VFS 107 on the spool 111 is reduced and the spool 111 is moved to the left in a retard mode in the figure by spring 115, until the force of spring 115 balances the force of the VFS 107.

In the retard mode shown, spool land 111*c* blocks the exit of fluid through exhaust line 122 from the CTA retard chamber 103. Lines 112 and 114 are open to the CTA advance chamber 102. Camshaft torque pressurizes the CTA advance chamber 102, causing fluid in the CTA advance chamber 102 to move into the CTA retard chamber 103, and the vane 104*a* to move towards the advance chamber wall 102*a* through cam torque energy. Fluid exits from the CTA advance chamber 102 through line 112 to the control valve 109 between spool lands 111*b* and 111*c* and recirculates back to common line 114, the retard check valve 110 and line 113 leading to the CTA retard chamber 103.

Fluid flowing to the CTA retard chamber 103 is prevented from flowing out of line 113 and through the control valve 109 by spool land 111*c*. Fluid exiting out of the CTA advance chamber 102, in addition to fluid from the supply line 119 flows into the OPA retard chamber 127, moving the vane 104*b* towards the advance wall 125*a*, therefore aiding the movement of the CTA vane 104*a* with oil pressure energy. Fluid in the OPA advance chamber 125 exits to sump through line 224, through the control valve between spool lands 111*c* and 111*d* to exhaust line 122. Therefore, the phaser can be actuated from either or both sources of energy, cam torque energy or source oil pressure energy.

When fluid is exiting the OPA advance chamber 125, the lock pin line 128 is depressurized and spring 131 biases the end portion of the lock pin 130 into engagement with the recess 132 of the housing assembly 100.

Makeup oil is supplied to the phaser from supply S by pump 140 to make up for leakage and enters line 119 through a bearing 120. Line 119 leads to an inlet check valve 118 and the control valve 109. From the control valve 109, fluid enters line 114 through the retard check valve 110 and flows to the CTA retard chamber 103.

The holding position of the phaser preferably takes place between the retard and advance position of the vane relative to the housing.

FIG. 6 shows the phaser in the null or holding position. In this position, the duty cycle of the variable force solenoid 107 is approximately 50% and the force of the VFS 107 on one end of the spool 111 equals the force of the spring 115 on the opposite end of the spool 111 in holding mode. The lands 111*b* and 111*c* blocks the exit of fluid from the CTA advance chamber 102 and the CTA retard chamber 103. These same lands 111*b*, 111*c* also allow fluid from the supply line 119 to flow into lines 223 and 224 to the OPA retard chamber 127 and the OPA advance chamber 125 through enlarged ports in the sleeve 116. Spool land 111*b* blocks exhaust line 121 and spool land 111*c* blocks exhaust line 122. Since equal pressure is being applied to both the OPA advance chamber 125 and the OPA retard chamber 127 the phaser will maintain position.

Makeup oil is supplied to the phaser from supply S by pump 140 to make up for leakage and enters line 119 through a bearing 120. Line 119 leads to an inlet check valve 118 and the control valve 109. From the control valve 109, fluid enters line 114 through the advance check valve 108 to the CTA advance chamber 102 and through the retard check valve 110 to the CTA retard chamber 103.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine comprising:

a housing assembly having an outer circumference for accepting drive force;

a rotor assembly coaxially located within the housing for connection to a camshaft, the housing assembly and the rotor assembly defining at least two vanes separating chambers in the housing assembly into advance chambers and retard chambers, wherein at least one of the two vanes is cam torque actuated and defines a cam torque actuated advance chamber and a cam torque actuated retard chamber, and at least an other of the at least two vanes is oil pressure actuated and defines an oil pressure actuated retard chamber and an oil pressure actuated advance chamber;

a supply line coupled to a fluid input;

at least one exhaust line;

a control valve movable between an advance mode, a retard mode, and a holding position, for directing fluid between the cam torque actuated retard chamber and the cam torque actuated advance chamber through an advance line, a common line with a retard check valve and an advance check valve, and a retard line;

wherein when the control valve is in the advance mode, fluid is routed from the cam torque retard chamber to the cam torque advance chamber through the advance check valve, and fluid to the cam torque advance chamber is additionally routed to the oil pressure actuated advance chamber and fluid from the oil pressure retard chamber is routed to the at least one exhaust line;

wherein when the control valve is in the retard mode, fluid is routed from the cam torque advance chamber to the cam torque retard chamber through the retard check valve, and fluid to the cam torque retard chamber is additionally routed to the oil pressure actuated retard chamber and fluid from the oil pressure advance chamber is routed to the at least one exhaust line; and wherein when the control valve is in the holding position, fluid is blocked from moving between the cam torque actuated advance chamber and the cam torque actuated retard chamber, maintaining the oil pressure actuated vane and the cam torque actuated vane in position through oil pressure.

2. The phaser of claim 1, further comprising a lock pin slidably located in the rotor assembly, the lock pin being moveable within the rotor assembly from a locked position in which an end of the lock pin engages a recess of the housing assembly, to an unlocked position in which the end portion does not engage the recess of the housing assembly.

3. The phaser of claim 2, wherein the lock pin is in fluid communication with the oil pressure actuated advance chamber and is moved to an unlocked position when the control valve is in the advance mode.

4. The phaser of claim 2, wherein the lock pin is in fluid communication with the oil pressure actuated retard chamber and is moved to an unlocked position when the control valve is in the retard mode.

5. The phaser of claim 1, wherein along the control valve, ports to the oil pressure advance line and the oil pressure retard line are separated axially.

6. The phaser of claim 1, wherein the control valve is located remotely from the phaser.

7. A variable camshaft timing phaser for an internal combustion engine comprising:

a housing assembly having an outer circumference for accepting drive force;

a rotor assembly coaxially located within the housing for connection to a camshaft, the housing assembly and the rotor assembly defining at least two vanes separating chambers in the housing assembly into advance chambers and retard chambers, wherein at least one of the two vanes is cam torque actuated and defines a cam torque actuated advance chamber and a cam torque actuated retard chamber, and at least an other of the at least two vanes is oil pressure actuated and defines an oil pressure actuated retard chamber and an oil pressure actuated advance chamber;

a supply line coupled to a fluid input;

at least one exhaust line;

a control valve movable between an advance mode, a retard mode, and a holding position; for directing fluid between the cam torque actuated retard chamber and the cam torque actuated advance chamber, through an advance line, a common line, and a retard line;

wherein when the control valve is moved to the advance mode, fluid is routed from the cam torque retard chamber to the cam torque advance chamber, fluid from the supply line is routed to the oil pressure actuated advance chamber, and fluid from the oil pressure retard chamber is routed to the at least one exhaust line;

wherein when the control valve is moved to the retard mode, fluid is routed from the cam torque advance chamber to the cam torque retard chamber, fluid from the supply line is routed to the oil pressure actuated retard chamber, and fluid from the oil pressure advance chamber is routed to the at least one exhaust line; and wherein when the control valve is in the holding position, fluid is blocked from moving between the cam torque actuated advance chamber and the cam torque actuated retard chamber, maintaining the oil pressure actuated vane and the cam torque actuated vane in position through oil pressure.

8. The phaser of claim 7, further comprising a lock pin slidably located in the rotor assembly, the lock pin being moveable within the rotor assembly from a locked position in which an end of the lock pin engages a recess of the housing assembly, to an unlocked position in which the end portion does not engage the recess of the housing assembly.

9. The phaser of claim 8, wherein the lock pin is in fluid communication with the oil pressure actuated advance chamber and is moved to an unlocked position when the control valve is in the advance mode.

10. The phaser of claim 8, wherein the lock pin is in fluid communication with the oil pressure actuated retard chamber and is moved to an unlocked position when the control valve is in the retard mode.

11. The phaser of claim 7, wherein along the control valve, ports to the oil pressure advance line and the oil pressure retard line are separated radially and are coplanar to ports leading to the advance line, retard line and common line.

12. The phaser of claim 7, wherein the control valve is located remotely from the phaser.

* * * * *